US006362800B1

(12) United States Patent
Moon

(10) Patent No.: US 6,362,800 B1
(45) Date of Patent: Mar. 26, 2002

(54) METHOD AND APPARATUS FOR DRIVING PLASMA DISPLAY PANEL

(75) Inventor: Seong Hak Moon, Kyounggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/356,683

(22) Filed: Jul. 19, 1999

(30) Foreign Application Priority Data

Jan. 17, 1998 (KR) ..... P98-1296

(51) Int. Cl.[7] ..... G09G 3/28

(52) U.S. Cl. ..... 345/60; 345/67; 345/63; 315/169.1; 315/169.2; 313/306; 313/309; 313/336; 313/351

(58) Field of Search ..... 345/60–63, 66–68; 315/169.1–169.4; 313/306, 309, 336, 351

(56) References Cited

U.S. PATENT DOCUMENTS

| | | | | | |
|---|---|---|---|---|---|
| 5,420,602 | A | * | 5/1995 | Kanazawa | 345/67 |
| 5,684,499 | A | * | 11/1997 | Shimizu et al. | 345/60 |
| 5,841,413 | A | * | 11/1998 | Zhu et al. | 345/63 |
| 5,995,069 | A | * | 11/1999 | Tokunage et al. | 345/60 |
| 6,057,815 | A | * | 5/2000 | Sano | 345/60 |
| 6,091,380 | A | * | 7/2000 | Hashimoto et al. | 345/60 |

* cited by examiner

*Primary Examiner*—Bipin Shalwala
*Assistant Examiner*—Jimmy H. Nguyen
(74) *Attorney, Agent, or Firm*—Fleshner & Kim, LLP

(57) ABSTRACT

A plasma display panel driving method is disclosed. In the method, a screen is divided into at least two blocks along scanning lines, and other blocks perform a sustaining process when a certain block performs an addressing process. Accordingly, the ratio of a time occupied by a sustaining interval in the entire frame is raised to improve a brightness level. Also, an addressing time is reduced to permit a high-speed driving. Since a reset interval is separated to increase the contrast.

4 Claims, 9 Drawing Sheets

METHOD AND APPARATUS FOR DRIVING PLASMA DISPLAY PANEL

BACKGROUND OF THE INVENTION

1. Field of the Invention

This invention relates to a flat panel display device, and more particularly to a method of driving a plasma display panel(PDP) that is capable of improving the brightness of the PDP and an apparatus thereof.

2. Description of the Prior Art

Nowadays, there have been actively developed flat panel display devices such as a liquid crystal display(LCD), a field emission display(FED), a plasma display panel (PDP) and so on. In the flat panel display devices, the PDP has advantages in that its manufacturing is easy due to its simple structure and that it has a high brightness and a high luminous efficiency compared with other flat panel display devices. Also, the PDP provides the improved memory ability and a wide light view angle of more than 160° C. Furthermore, the PDP device has an advantage in that it can implement a large-scale screen of more than 40 inches. Such a PDP is classified into a direct current(DC) system and an alternating current(AC) system. As shown in FIG. 1, the PDP of conventional AC system includes a lower glass substrate 10 mounted with address electrodes 12 and an upper glass substrate 20 mounted with a sustaining electrode pair 22. On the lower glass substrate 10 mounted with the address electrodes 12, a desired thickness of lower dielectric thick film 14 for generating a wall charge and a barrier rib 16 for dividing discharge cells are sequentially formed. A desired thickness of fluorescent film 18 is coated on the surface of the lower dielectric thick film 14 and the wall surface of the barrier rib 16. At the bottom side of the upper glass substrate 20 mounted with the sustaining electrode pair 22, an upper dielectric thick film 24 and a protective film 26 are sequentially formed. The upper dielectric thick film 24 generates a wall charge like the lower dielectric thick film 14, and the protective film 26 protects the upper dielectric thick film 24 from an impact due to a gas ion during plasma discharge.

The conventional driving principle of the PDP will be described in conjunction with FIG. 2. As shown in FIG. 2, a panel 30 has n first sustaining electrodes Y1 to Yn and n second sustaining electrodes Z1 to Zn arranged alternately in parallel to each other m address electrodes Al to Am are arranged perpendicularly to the first and second sustaining electrodes Y1 to Yn and Z1 to Zn discharge cells 32 are provided at each intersection between the address electrodes Am and the first and second sustaining electrodes Yn and Zn. The discharge cells 32 are divided by the barrier ribs 16 and a mixture gas of He+Xe or Ne+Xe is sealed into the discharge cells 32. If a desired voltage is applied between the address electrode 12 and the first sustaining electrode Yn to drive the PDP, then an address discharge is generated to select the discharge cells 32. At this time, a wall charge is accumulated in the discharge cells 32 by the address discharge to lower a voltage for the sustaining discharge. Subsequently, if a desired voltage is applied between the first and second sustaining electrodes Yn and Zn only at the cells selected by the address discharge, then vacuum ultraviolet rays are generated by the sustaining discharge. At this time, fluorescent materials included in the fluorescent film 18 with red(R), green(G) and blue(B) colors is radiated by the vacuum ultraviolet rays to thereby emit R, G and B visible light rays. The visible rays generated from the fluorescent film 18 are emitted by way of the upper glass substrate 20 to thereby display a picture including characters and graphics.

Generally, a cathode ray tube(CRT) controls an intensity of an electron beam irradiated onto the fluorescent body so as to express the gray scale of a picture. However, since it is difficult the PDP of AC system to control a discharge intensity by such a method, the PDP of AC system expresses the gray scale of a picture by controlling a discharge frequency per hour. In other words, when it is assumed that a time displaying a single image on the entire screen once and sustaining the image be one frame, one frame is divided into n sub-fields. Each cell is turned on only at the corresponding sub-field in each sub-field to generate a discharge, whereas it is turned off at the other sub-fields not to generate a discharge. Accordingly, the brightness of each cell is determined by combining a discharge frequency at the discharged sub-field to thereby implement a gray scale of $2^n$. A typical gray scale implementation method based on the concept as described above includes the addressing and display separation(ADS) system. The ADS system will be described in conjunction with FIG. 3 below.

FIG. 3 is a view for explaining the conventional PDP driving method. As shown in FIG. 3, one frame is divided into 8 sub-fields SF1 to SF8 so as to implement 256 gray scales. Each sub-field is divided into a reset interval, an address interval and a sustaining interval and then driven.

The reset interval is a time period for initializing a screen by writing the entire screen simultaneously and thereafter erasing the entire screen. To this end, a writing pulse is applied between the first sustaining electrodes Y1 to Yn and the second sustaining electrodes Z1 to Zn simultaneously to turn on all the cells on the screen. Subsequently, an erasing pulse is applied between the first sustaining electrodes Y1 to Yn and the second sustaining electrodes Z1 to Zn simultaneously to turn off all the cells on the screen, thereby initializing the entire screen.

The address interval is a time period for selectively discharging only the cells to be turned on at the corresponding sub-field. To this end, −Vs voltage is applied to the first sustaining electrode at a line intended to perform an addressing, whereas Va voltage is applied only to the address electrode at the cell to be turned on in m×3 cells connected to the first sustaining electrodes. At this time, since the sum of Va voltage and Vs voltage is higher than a critical voltage required for a discharge, an address discharge is generated at the cell applied with Va to form a wall charge. Also, since the Vs voltage is lower than the critical voltage, the cell applied with Va does not generate an address discharge. When such a process is sequentially and repeatedly performed n times with respect to n horizontal lines, n×(3m) cells are addressed.

In the sustaining interval, only the cell generating an address discharge performs a sustaining discharge to display and sustain the cell turned on. To this end, a sustaining pulse having Vs voltage is alternately applied between the first and second sustaining electrodes Yl to Yn and Z1 to Zn in a state in which OV is applied to the address electrodes Al to Am. When one frame is divided into 8 sub-fields, a weighting value of 1:2:4:8: . . . :128 ratio is given in the sustaining interval to express a gray scale by the combination of the sustaining intervals. The sub-field intervals corresponding to each bit are displayed in a sequence of SF1, SF2, SF3, SF4, SF5, SF6, SF7 and SF8.

Meanwhile, since each sub-field SF1 to SF8 has different sustaining intervals while having an interval for resting and addressing the entire screen, the reset and addressing intervals becomes same at the 8 sub-field. An efficiency of an ADS system in which a time for one frame is 16.67ms(i.e., 1/60 second) will be calculated. Assuming that a time required for a resetting per one sub-field be 200μs, since one frame is 200μs ×8 sub-fields, a time of about 1.6ms is required. Also, assuming that a time required for an address interval be 3 μs, since one frame having 480 horizontal lines is 200 μs×480 lines ×8 sub-fields, a time of about 11.52 ms is required. In this case, a sustaining interval contributing to the real brightness in the entire frame time of 16.67 ms is 3.55 ms, a low light efficiency of 20.1% is obtained. As a result, the conventional PDP has a problem in that it is difficult to obtain a sufficient brightness level and hence the brightness is deteriorated.

SUMMARY OF THE INVENTION

Accordingly, it is an object of the present invention to provide a plasma display panel driving method and apparatus that is capable of improving the brightness of a plasma display panel.

In order to achieve these and other objects of the invention, a plasma display panel driving method according to one aspect of the present invention divides a screen into at least two blocks along scanning lines, and allows other blocks to perform the sustaining process during a time interval when a certain block performs the addressing process.

A plasma display panel driving apparatus according to another aspect of the present invention includes a plasma panel having a number of cells, said cells including a plurality of address electrode lines, scanning and sustaining electrode lines formed to be opposed perpendicularly every the address electrode lines, and common sustaining electrode lines formed to be parallel with the scanning and sustaining electrode lines; an address electrode driver for driving the address electrode lines; a scanning and sustaining electrode driver for dividing the scanning and sustaining electrode lines into at least two parts and driving each part sequentially; a common sustaining electrode driver for dividing the common sustaining electrode line into at least two parts and driving each part commonly; and a memory and controller for controlling a timing of each of the drivers and storing an input data.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
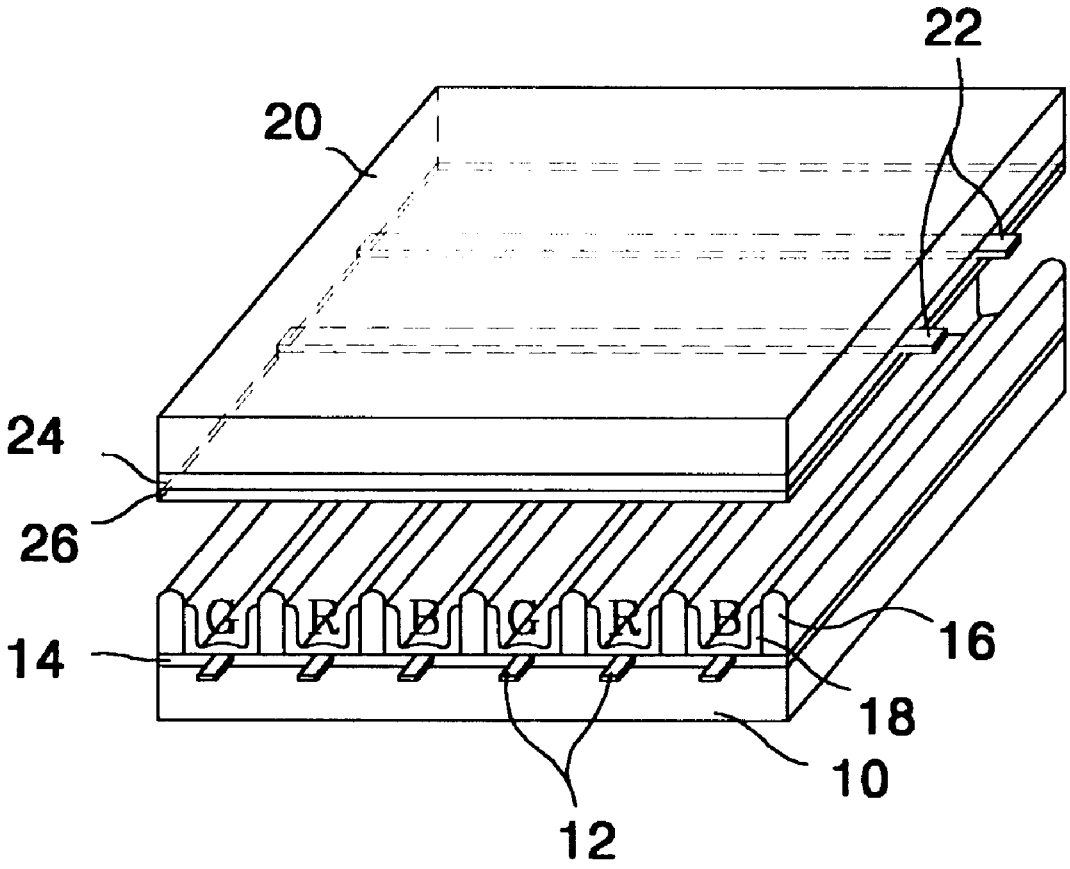
FIG. 1 RELATED ART
FIG. 1 is a perspective view showing the structure of a conventional three-electrode AC system plasma display panel.
Figure 2:
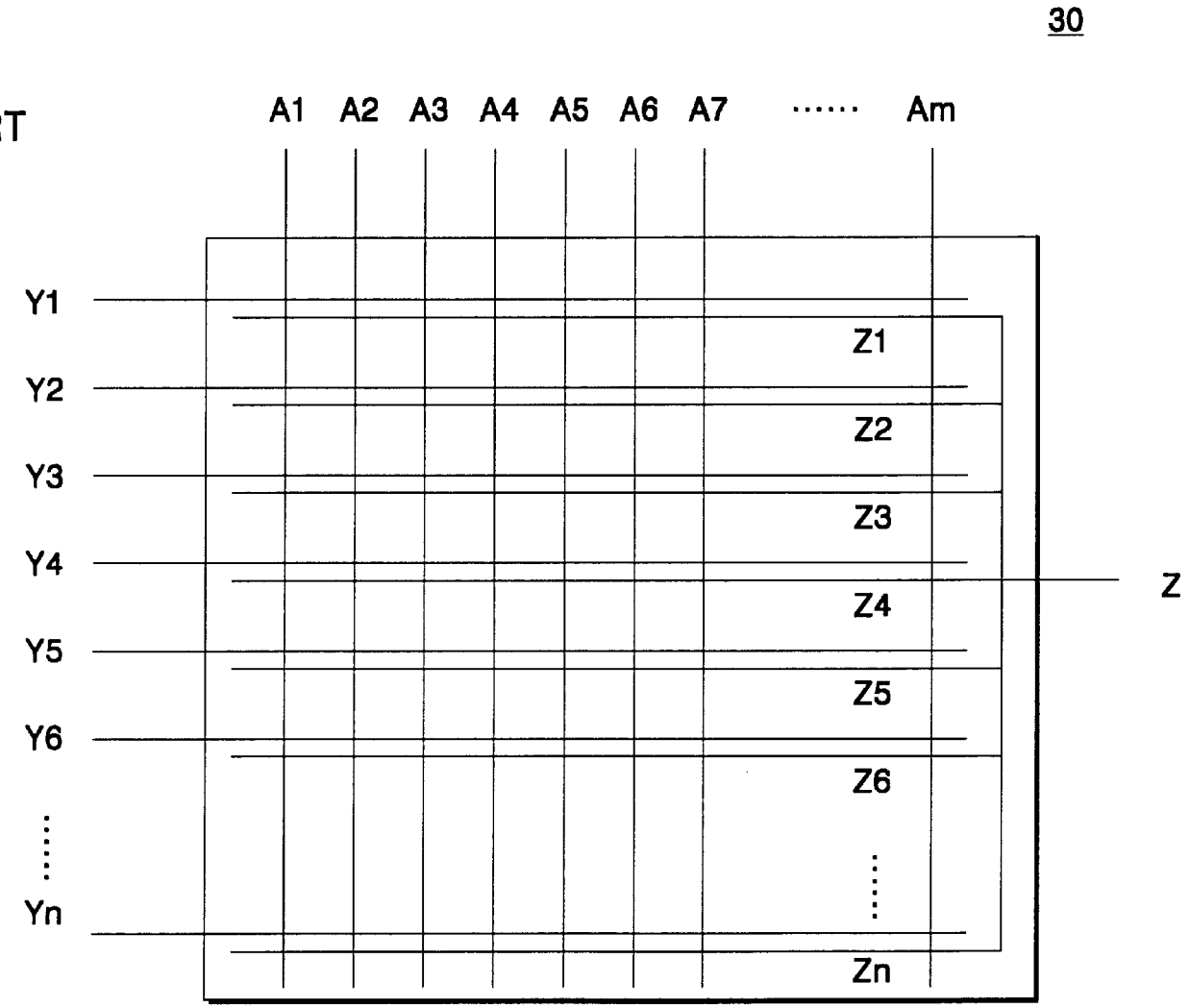
FIG. 2 RELATED ART
FIG. 2 shows an entire electrode arrangement of the plasma display panel in FIG. 1.
Figure 3:
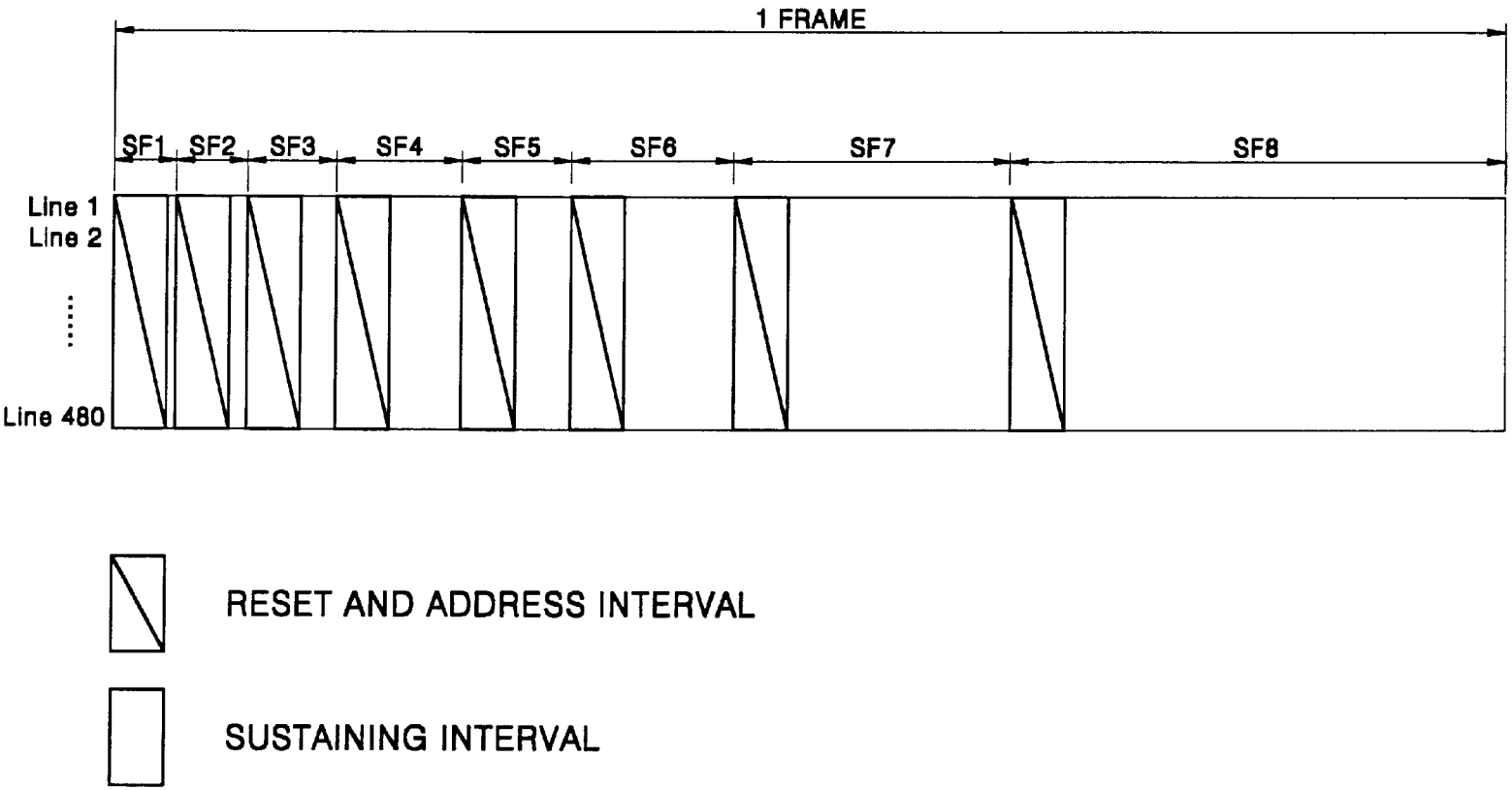
FIG. 3 RELATED ART
FIG. 3 is a view for explaining the conventional plasma display panel driving method.
Figure 4:
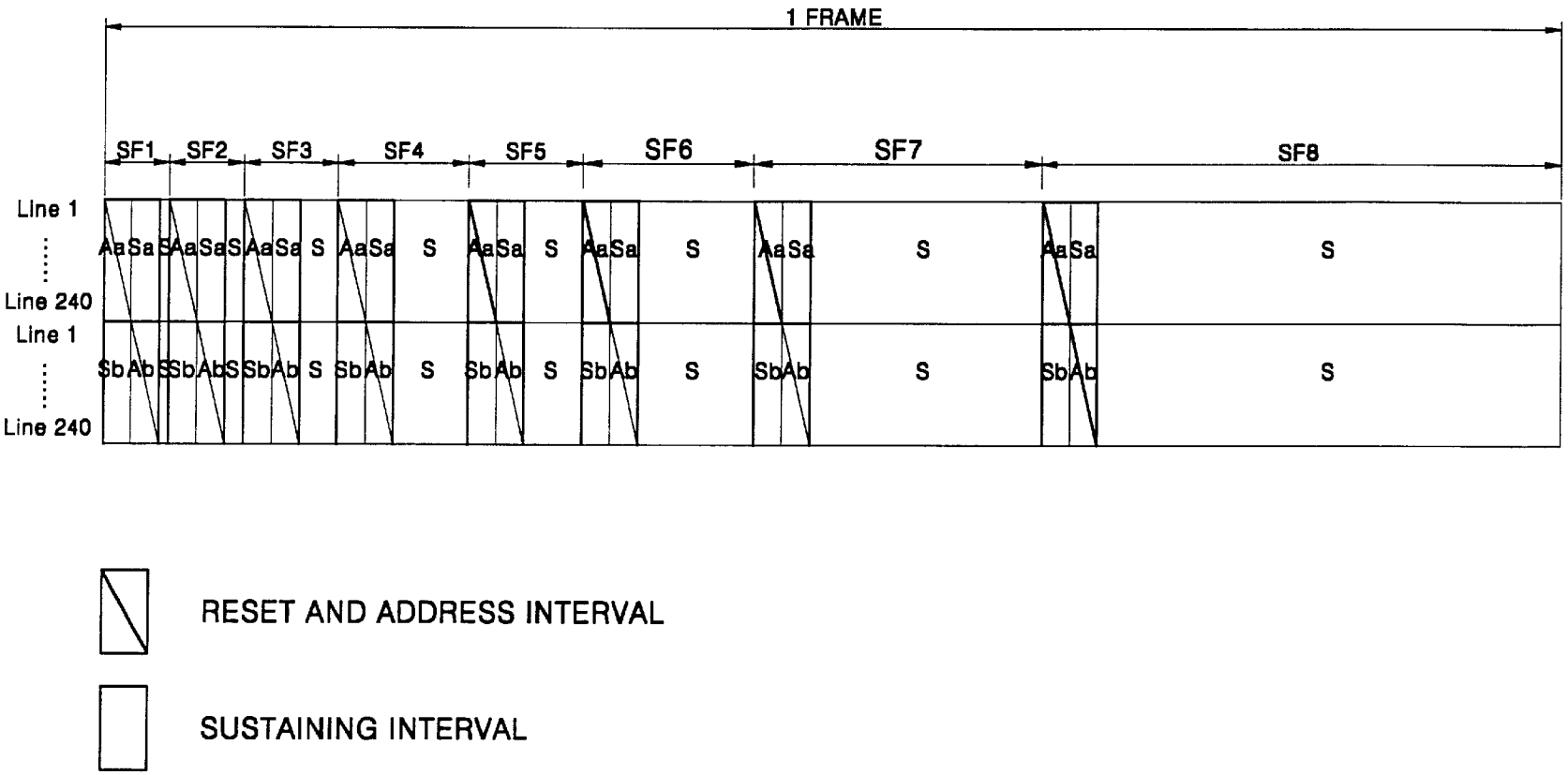
FIG. 4 is a view for schematically explaining a plasma display panel driving method according to the present invention.

FIG. 4 schematically explains a PDP driving method according to the present invention. Referring to FIG. 4, the entire screen is divided into two blocks to drive each block independently. When the entire screen is 480 lines, 1st to 240th lines are divided into a block and 241st to 480th lines are divided into b block to drive each block independently. First, a discharge is caused between first and second sustaining electrodes Y1 to Y240 and Z1 to Z240 at all the lines constructing the a block to perform a reset interval producing a wall charge at all the cells in the a block. Subsequently, a process in which a scanning pulse having −Vs voltage is applied to the first sustaining electrodes Y1 to Y240 and a pulse having Va voltage is applied to address electrodes in the cells to be turned on, is sequentially performed with respect to all the first sustaining electrodes in the a block. When an addressing process for the lines in the a block is being performed, a reset pulse is not applied to the b block and a positive(+) voltage of sustaining pulse is applied to the first sustaining electrodes to thereby sustain the previous state.

After the termination of said process, the a block sustains the previous state when a reset and addressing process for lines in the b block is being performed. Subsequently, a common sustaining process for sustaining the a block and the b block simultaneously is performed to terminate a first sub-field SF1. If all the second to eighth sub-fields SF2 to SF8 are performed in the same manner, then one frame is terminated.

In an embodiment of the present invention, the entire screen is divided into two blocks and one block is sustained when an addressing process for the other block is being performed, thereby raising a ratio occupied by a discharge time in the entire frame. At one frame having 480 horizontal lines, the reset and addressing interval requires a time adding (3μs ×480 lines ×8 sub-fields)/2 to (200μs ×8 sub-fields), i.e., a time of about 7.36 ms. In this case, a sustaining interval contributing to the real brightness in the entire frame time of 16.67 ms is 9.31 ms, so that a light efficiency of 55.8% is obtained. This shows an increase of about 2.8 times compared with a light efficiency(e.g., 20.1%) in the prior art.

Figure 5:
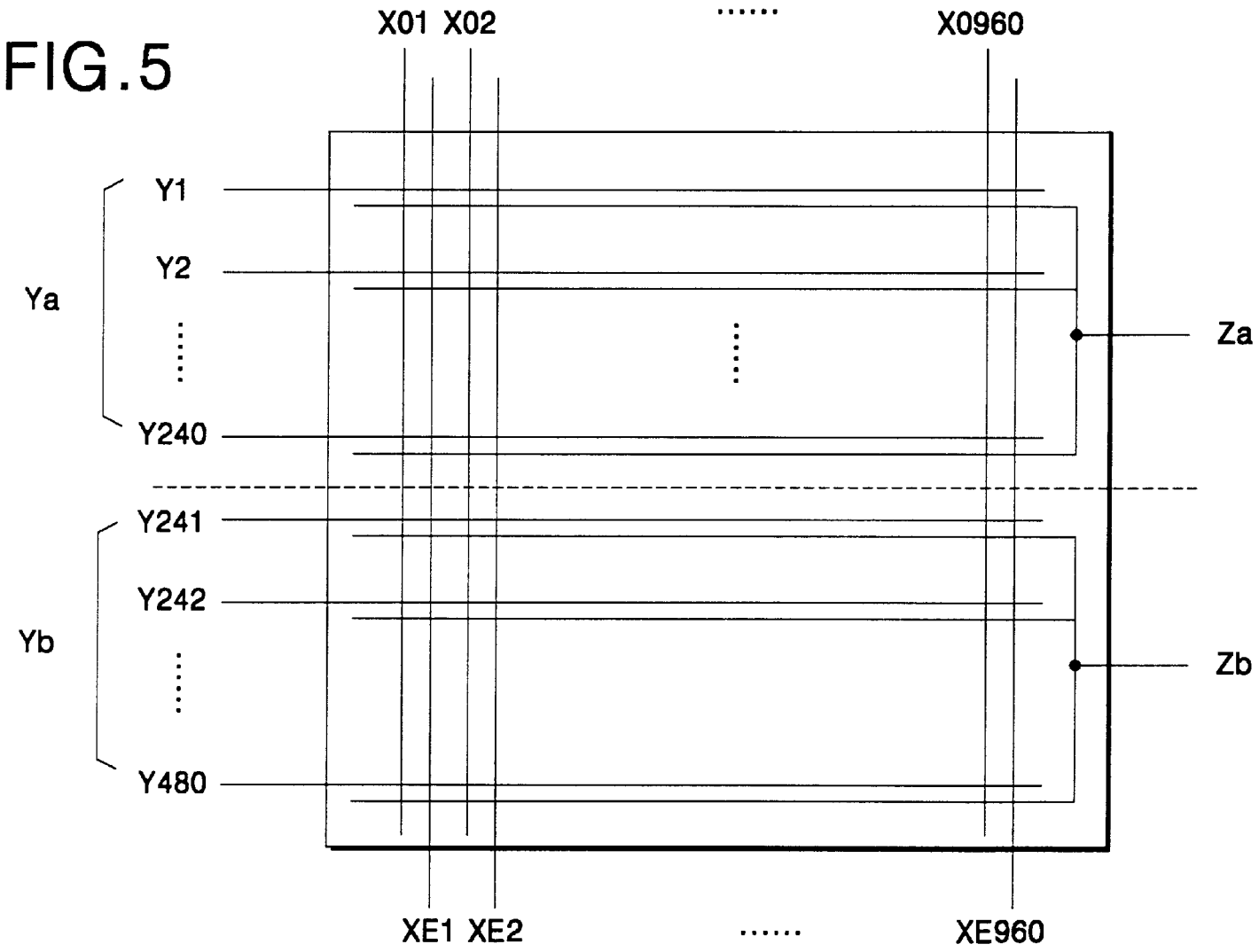
FIG. 5 shows electrodes in the plasma display panel according to the present invention which are divided into two blocks.

FIG. 5 shows an electrode arrangement made by dividing the first and second sustaining electrodes into two blocks in order to perform the above-mentioned operation. Referring now to FIG. 5, first and second sustaining electrodes Y1 to Y240 and Z1 to Z240 from the first line until the 240th line make a block. The first and second sustaining electrodes Y1 to Y240 and Z1 to Z240 from the 241st line until the 480th line make b block. The first and second sustaining electrodes Y1 to Yn and Z1 to Zn are provided with odd-numbered address electrodes XO1 to XO960 and even-numbered address electrodes XE1 to XE960 which are arranged perpendicularly to each other. In this case, it is assumed that the first sustaining electrodes Y1 to Y240 including the a block be Ya and the first sustaining electrodes Y241 to Y480 including the b block be Yb. The first sustaining electrodes Yn is referred to as "scanning and sustaining electrodes" because they are used for an address discharge as well as a sustaining discharge. On the other hand, the second sustaining electrodes Z1 to Z240 corresponding to the a block are commonly connected to a single terminal Za while the second sustaining electrodes Z241 to Z480 corresponding to the b block are commonly connected to a single terminal Zb. The second sustaining electrodes Zn are referred to as "common sustaining electrodes" because they are commonly connected and perform a sustaining discharge. A PDP driving apparatus for driving the PDP having an electrode arrangement as described above will be explained in conjunction with FIG. 6 below.

Figure 6:
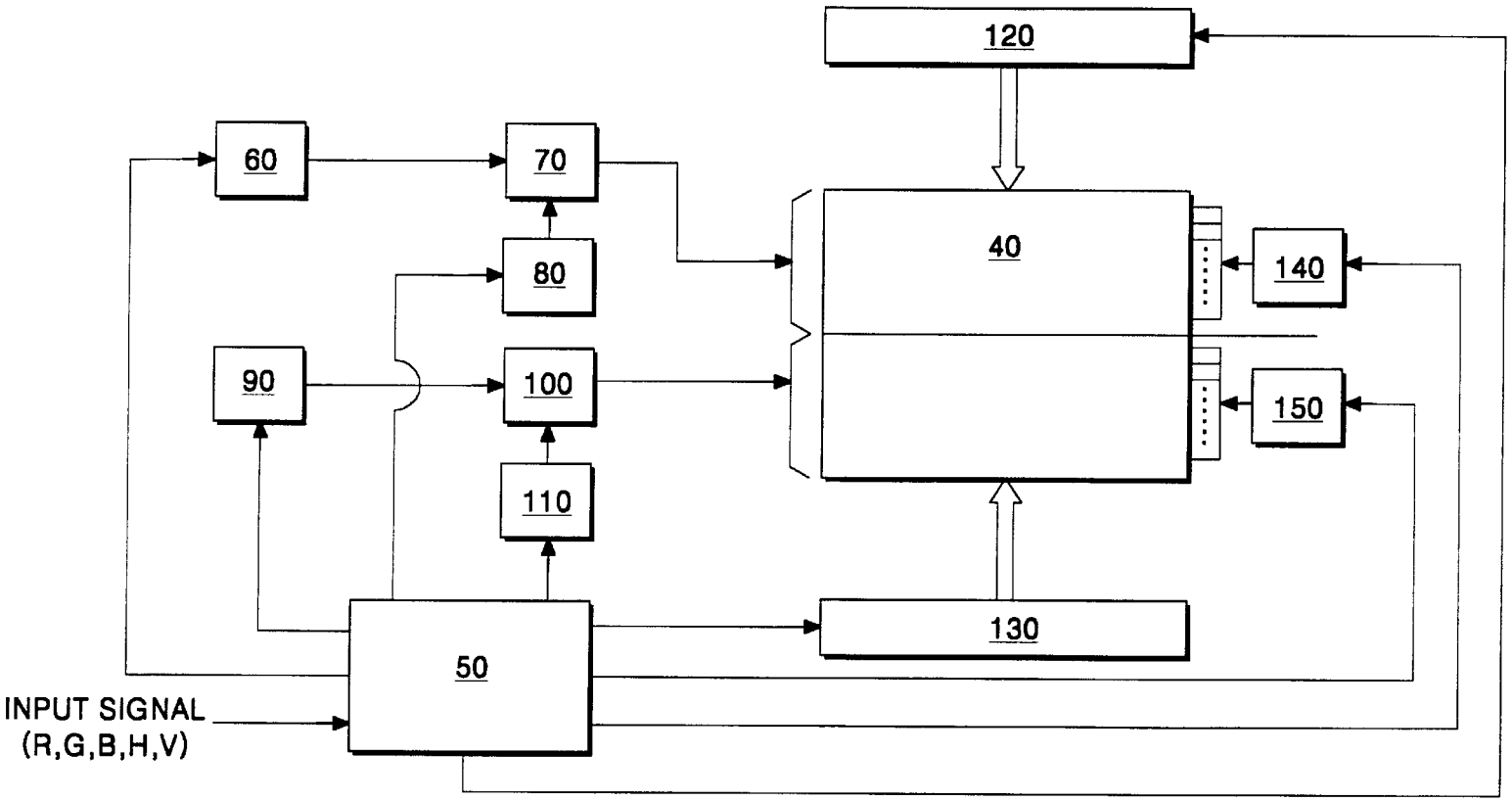
FIG. 6 is a block diagram showing the configuration of a plasma display panel driving apparatus according to the present invention.

Referring to FIG. 6, the PDP driving apparatus includes a Ya driving integrated circuit(IC) 70 for applying a driving pulse to first sustaining electrodes in a block of a plasma display panel 40, a memory and controller 50 for storing an input signal and for generating a timing control signal, a Ya driving IC controller 60 for driving the Ya driving IC 70 by the timing control signal, a Ya sustaining driver 80 for generating a sustaining pulse under control of the system controller 50, and a Za sustaining driver 140 for applying a driving pulse to the second sustaining electrodes in the a block under control of the memory and controller 50. When an input signal from the exterior(e.g., R, G, and B horizontal synchronizing signals H and vertical synchronizing signals V) is applied to the memory controller 50, the memory controller 50 stores the R, G and B image signals and thereafter applies the image signals to odd and even address electrode drivers 120 and 130. At this time, the odd electrode driver 120 drives the odd-numbered address electrodes. On the other hand, the even electrode driver 130 drives the even-numbered address electrodes. By the timing control signal of the memory and controller 50, the Ya driving IC controller 60 drives the Ya driving IC 70. Accordingly, a driving pulse is applied to the first sustaining electrodes in the a block connected to the Ya driving IC 70. In this case, since a driving voltage is applied between the odd-numbered and even-numbered address electrodes and the first sustaining electrodes in the a block, an address discharge is generated.

Further, the PDP driving apparatus includes a Yb driving IC 100 for applying a driving pulse to the first sustaining electrodes in the b block of the plasma display panel 40, a Yb driving IC controller 90 for driving the Yb driving IC 100 by the timing control signal, a Yb sustaining driver 90 for generating a sustaining pulse under control of the system controller 50, and a Zb sustaining driver 1S0 for applying a driving pulse to the second sustaining electrodes in the b block under control of the system controller 50. A Ya driving IC controller 60 drives the Ya driving IC 70 by the timing control signal of the system controller 50. In this case, a driving pulse is applied to the first sustaining electrodes in the a block connected to the Ya driving IC 70. The Yb sustaining driver 90 generating the sustaining pulse under control of the system controller generates a sustaining pulse and applies it to the second sustaining electrodes in the b block. In this case, a driving voltage is applied between the first and second sustaining electrodes in the b block. When the a block in the plasma panel 40 as described above is in the address interval, the b block is in the sustaining interval. On the other hand, when the a block is in the sustaining interval, the b block is in the address interval. When the a block and the b block is in a common sustaining interval, the a block and the b block is in the sustaining interval.

Figure 7:
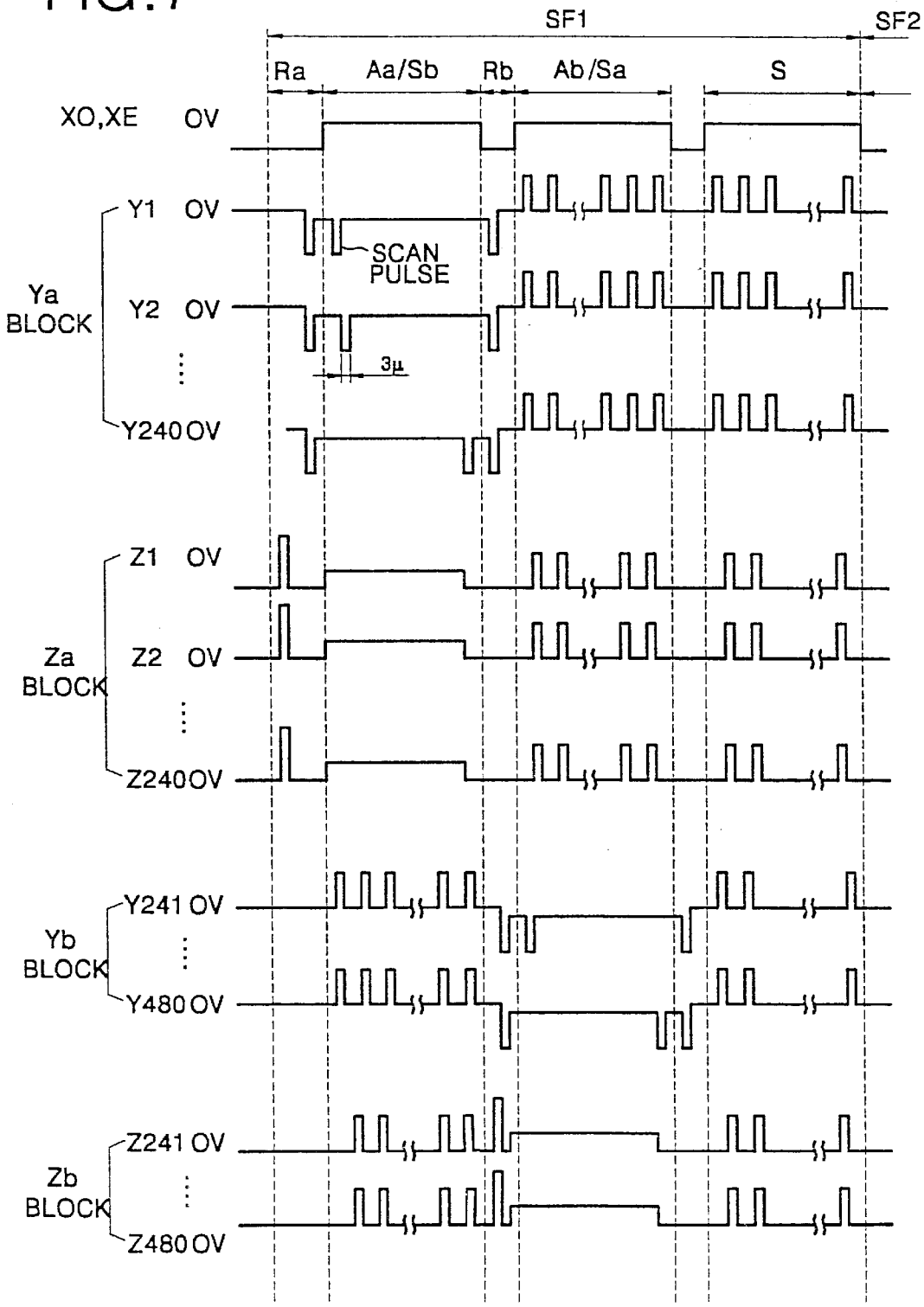
FIG. 7 shows driving pulses for the purpose of explaining a plasma display panel driving method according to an embodiment of the present invention.

FIG. 7 shows waveforms of driving pulses for explaining a PDP driving method according to an embodiment of the present invention. In FIG. 7, address pulses applied to each of the odd-numbered and even-numbered address electrode are called XO and XE, respectively. Driving pulses applied to the first and second sustaining intervals included in the a block are called Ya and Za, respectively. A reset interval, an address interval and a sustaining interval in the a block are called Ra, Aa and Sa, respectively. A common sustaining interval in the a and b blocks is called S.

As shown in FIG. 7, during the Ra interval at which the a block is reset, the b block becomes a blank interval. When the a block is in an address interval Aa, the b block becomes a sustaining interval Sb. On the other hand, during the Rb interval at which the b block is reset, the a block becomes a blank interval. When the b block is in an addressing interval Ab, the a block becomes a sustaining interval Sa. After the addressing of the entire lines is terminated as described, the a block and the b block have the common sustaining interval S for simultaneously sustaining them after passing the blank interval simultaneously.

In the Ra interval which is a reset interval of the a block, 0V is applied to the first sustaining electrodes corresponding to the a block and a reset pulse having a desired voltage level is applied between the second sustaining electrodes.

In the Aa interval which is an address interval of the a block, a scanning pulse having a desired voltage level is sequentially applied to the first sustaining electrodes corresponding to the a block and an address pulse having a desired voltage level(e.g., Vs/2) is applied to the address electrodes, thereby selectively discharging the cells to be turned on at the a block. In this case, each electrode in the a block(i.e., Y1 to Y240 and Z1 to Z240) performs an addressing process sequentially. A sustaining time of the scanning pulse is 3$\mu$s. At the same time, in the Sb interval, a sustaining pulse having a desired voltage level is applied to the first and second sustaining electrodes in the b block to sustain the previous state continuously.

In the Rb interval which is a reset interval of the b block, OV is applied to the first sustaining electrodes corresponding to the b block and a reset pulse having a desired voltage level is applied between the second sustaining electrodes. In this case, each electrode in the b block(i.e., Y241 to Y480 and Z241 to Z480) performs an addressing process sequentially. A sustaining time of the scanning pulse is 3$\mu$s.

In the Ab interval which is an address interval of the b block, a scanning pulse having a desired voltage level is sequentially applied to the first sustaining electrodes corresponding to the b block and an address pulse having a desired voltage level(e.g., Vs/2) is applied to the address electrodes, thereby selectively discharging the cells to be turned on at the b block. At the same time, in the Sa interval, a sustaining pulse having a desired voltage level is applied to the first and second sustaining electrodes in the a block to sustain the previous state continuously.

In the S interval, a sustaining pulse having a desired voltage level is applied to the first and second sustaining electrodes in the a and b blocks to sustain the previous state continuously.

The second to eighth sub-fields are carried out in the same manner to thereby display one frame. As described above, the PDP driving method according to an embodiment of the present invention divides the entire screen into two blocks and drives each block independently to increase the sustaining interval. Accordingly, a light efficiency can be increased and a brightness level can be improved.

Figure 8:
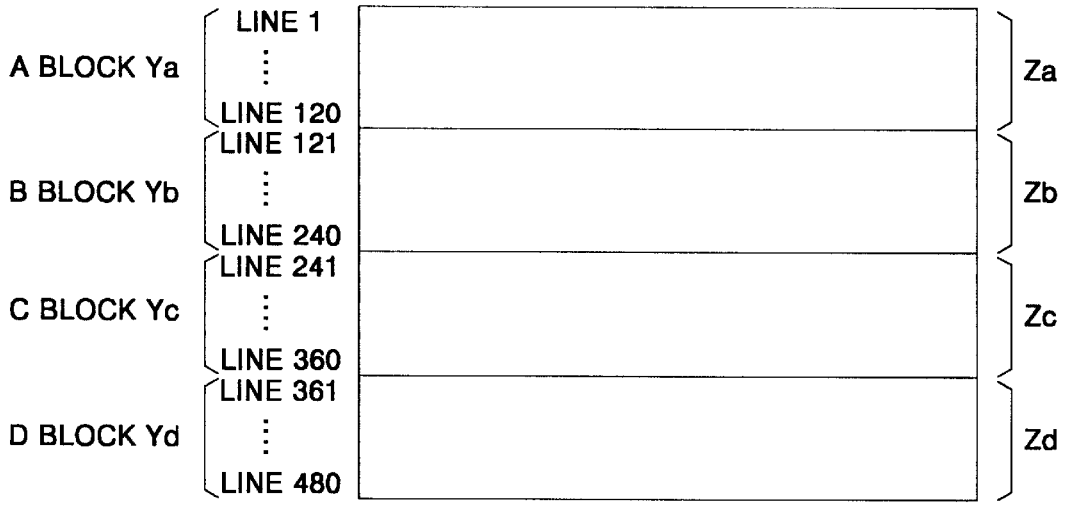
FIG. 8 shows electrodes in the plasma display panel according to the present invention which are divided into four blocks.

A PDP driving method according to another embodiment of the present invention will be described with reference to FIG. 8 and FIG. 9. As shown in FIG. 8, 1st to 120th lines of the entire screen are divided into a block; 121st to 240th lines into b block; 241st to 360th lines into c block; and 361st to 480th lines into d block. In this case, the first sustaining electrodes Y1 to Y120 included in the a block is called Ya, and the second sustaining electrodes Z1 to Z120 are commonly connected to a single terminal Za. The first sustaining electrodes Y121 to Y240 included in the b block is called Yb, and the second sustaining electrodes Z121 to Z240 are commonly connected to a single terminal Zb. The first sustaining electrodes Y241 to Y360 included in the c block are called Yc, and the second sustaining electrodes Z241 to Z360 are commonly connected to a single terminal Zc. The first sustaining electrodes Y361 to Y480 are called Yd, and the second sustaining electrodes Z361 to Z480 are commonly connected to a single terminal Zd.

Figure 9:
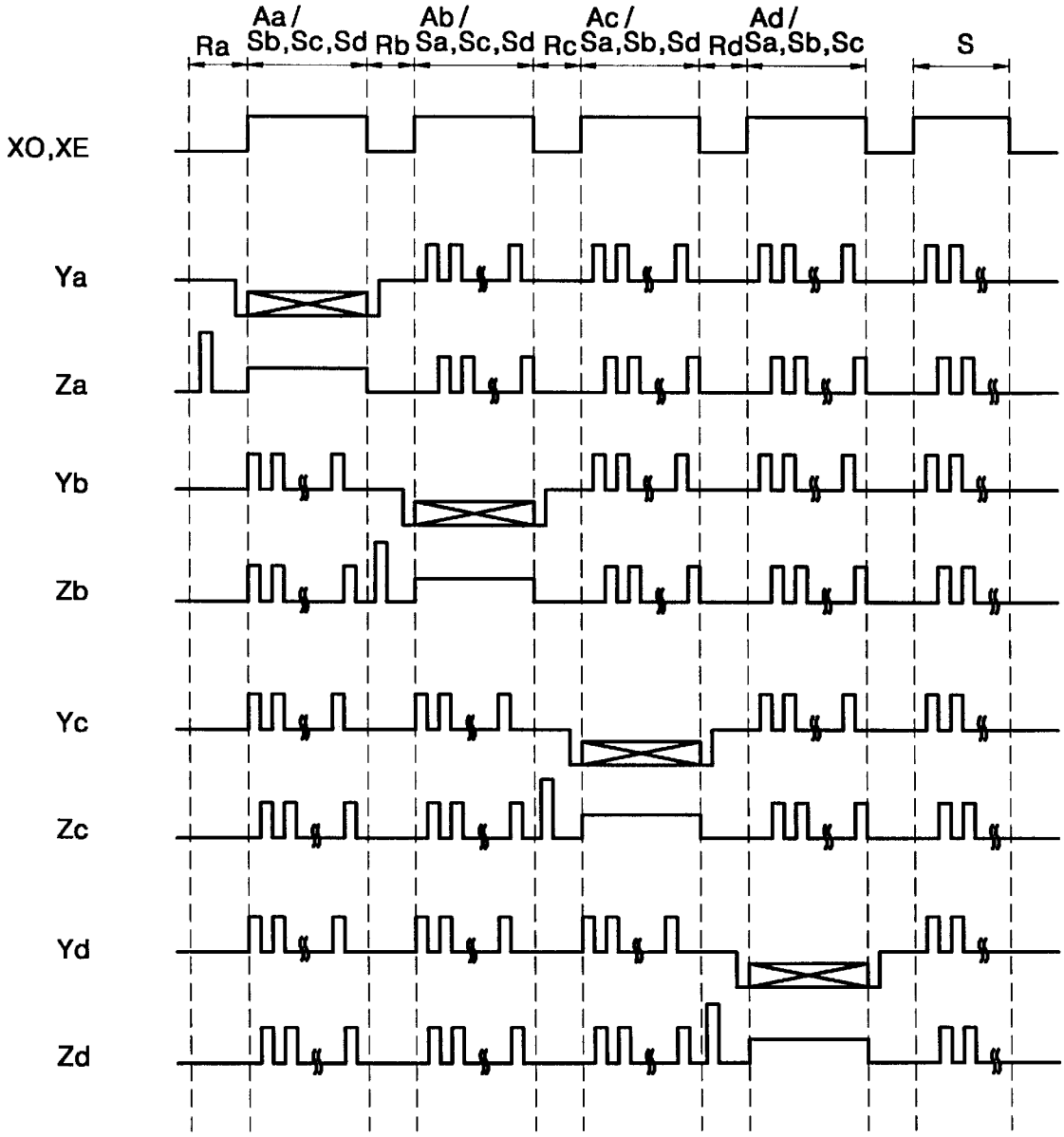
FIG. 9 shows driving pulses for the purpose of explaining a plasma display panel driving method according to an embodiment of the present invention.

FIG. 9 is a view for explaining the PDP driving method according to another embodiment of the present invention. As shown in FIG. 9, during the Ra interval at which the a block is reset, the b, c and d blocks become a blank interval. When the b block is in the address interval Ab, the b, c and d blocks becomes sustaining intervals Sb, Sc and Sd, respectively. During the Rb interval at which the b block is reset, the a, c and d blocks become a blank interval. When the b block is in the address interval Ab, the a, c and d blocks becomes sustaining intervals Sa, Sc and Sd, respectively. During the Rc interval at which the c block is reset, the a, b and d blocks become a blank interval. When the c block is in the address interval Ac, the a, b and d blocks become sustaining intervals Sa, Sb and Sd, respectively. During the Rd interval at which the d block is reset, the a, b and c blocks become a blank interval. When the d block is in the address interval Ad, the a, b and c blocks become sustaining intervals Sa, Sb and Sc, respectively. After the addressing of the entire lines was terminated as described above, the a to d blocks have a common sustaining interval S for simultaneously sustaining them after passing the blank interval simultaneously. Hereinafter, the PDP driving method according to the present invention will be described in detail in conjunction with each interval.

In the Ra interval which is a reset interval of the a block, OV is applied to the first sustaining electrodes corresponding to the a block and a reset pulse having a desired voltage level is applied between the second sustaining electrodes. At this time, the b, c and d blocks become a blank interval.

In the Aa interval which is an address interval of the a block, a scanning pulse having a desired voltage level is sequentially applied to the first sustaining electrodes corresponding to the a block and an address pulse having a desired voltage level(e.g., Vs/2) is applied to the address electrodes, thereby selectively discharging the cells to be turned on at the a block. In this case, each electrode in the a block(i.e., Y1 to Y240 and Z1 to Z240) performs an addressing process sequentially. At the same time, in the Sb, Sc and Sd intervals, a sustaining pulse having a desired voltage level is applied to the first and second sustaining electrodes in each of the b, c and d blocks to sustain the previous state continuously.

In the Rb interval which is a reset interval of the b block, OV is applied to the first sustaining electrodes corresponding to the b block and a reset pulse having a desired voltage level is applied between the second sustaining electrodes. At this time, the a, c and d blocks become a blank interval.

In the Ab interval which is an address interval of the b block, a scanning pulse having a desired voltage level is sequentially applied to the first sustaining electrodes corresponding to the b block and an address pulse having a desired voltage level(e.g., Vs/2) is applied to the address electrodes, thereby selectively discharging the cells to be turned on at the b block. In this case, each electrode of the b block(i.e., Y121 to Y240 and Z121 to Z240) performs an addressing process sequentially. At the same time, in the Sa, Sc and Sd intervals, a sustaining pulse having a desired voltage level is applied to the first and second sustaining electrodes in each of the a, c and d blocks to sustain the previous state continuously.

In the Rc interval which is a reset interval of the c block, OV is applied to the first sustaining electrodes corresponding to the b block and a reset pulse having a desired voltage level is applied between the second sustaining electrodes. At this time, the a, b and d blocks become a blank interval.

In the Ac interval which is an address interval of the c block, a scanning pulse having a desired voltage level is sequentially applied to the first sustaining electrodes corresponding to the c block and an address pulse having a desired voltage level(e.g., Vs/2) is applied to the address electrodes, thereby selectively discharging the cells to be turned on at the b block. In this case, each electrode of the c block(i.e., Y241 to Y360 and Z241 to Z360) performs an addressing process sequentially. At the same time, in the Sa, Sb and Sd intervals, a sustaining pulse having a desired voltage level is applied to the first and second sustaining electrodes in each of the a, b and d blocks to sustain the previous state continuously.

In the Rd interval which is a reset interval of the d block, OV is applied to the first sustaining electrodes corresponding to the d block and a reset pulse having a desired voltage level is applied between the second sustaining electrodes. At this time, the a, b and c blocks become a blank interval.

In the Ad interval which is an address interval of the d block, a scanning pulse having a desired voltage level is sequentially applied to the first sustaining electrodes corresponding to the d block and an address pulse having a desired voltage level(e.g., Vs/2) is applied to the address electrodes, thereby selectively discharging the cells to be turned on at the d block. In this case, each electrode of the d block(i.e., Y361 to Y480 and Z361 to Z480) performs an addressing process sequentially. At the same time, in the Sa, Sb and Sc intervals, a sustaining pulse having a desired voltage level is applied to the first and second sustaining electrodes in each of the a, b and c blocks to sustain the previous state continuously.

In the S interval, a sustaining pulse having a desired voltage level is applied to the first and second sustaining electrodes in the a to d blocks to sustain the previous state continuously.

The second sub-field SF2 to the eighth sub-field SF8 are carried out in the same manner to thereby display one frame. As described above, the PDP driving method according to an embodiment of the present invention divides the entire screen into four blocks and drives each block independently to increase the sustaining interval. Accordingly, a light efficiency can be increased and a brightness level can be improved.

As described above, the PDP driving method and apparatus divides the entire screen into a desired number of blocks along the horizontal line and allows other blocks to continue the sustaining operation during a time interval when an addressing operation for one block is performed to thereby raise the ratio of a time occupied by the sustaining interval in the entire frame, so that it can improve a brightness level compared with the prior art PDP. Also, it reduces an addressing time to permit a high-speed driving.

Furthermore, since it drives the PDP by separating the reset interval, it raises the contrast. Also, since it divides the screen into a plurality of blocks and drives each block independently, it decreases a current in the driving circuit so that a low-current driving circuit can be used, thereby reducing a manufacturing cost thereof.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For instance, it should be understood that the entire screen has been divided into two blocks or four blocks in the embodiments of the present invention, but it may be divided into n blocks at a designer's intention. Accordingly, the scope of the invention shall be determined only by the appended claims and their equivalents.

What is claimed is:

1. A method of driving a plasma display panel in a sub-field system including a reset step initializing each cell of a screen at each sub-field, an addressing step selecting cells to be displayed in each of the reset cells, and a sustaining step causing a sustaining discharge with respect to the addressed cells, the method comprising:

dividing the screen into a plurality of blocks along scanning lines and applying a reset pulse to only each scanning line of a block to initialize it and simultaneously allowing remaining-immediately the reset blocks to have a blanking interval to which pulses are not applied;

sequentially performing an addressing process with respect to the scanning lines in the initialized block to select the cells to be displayed and, at the same time, performing a sustaining discharging at cells, which are selected in a previous sub-field, included in the remaining-immediately reset blocks;

allowing the block in which the addressing process has been completed to have a blanking interval to which pulses are not applied and simultaneously applying a reset pulse to only each scanning line of another block to initialize it;

performing an addressing process sequentially with respect to the scanning lines in the initialized block to select the cells to be displayed and, at the same time, performing a sustaining discharging at cells, which are selected in a previous sub-field and a current sub-field, included in the remaining-immediately reset blocks; and allowing a sustaining discharge for the blocks in the addressing process previously completed to be continued and simultaneously performing a sustaining discharge for a last block, after an address process for the last block is completed.

2. The method claimed in claim 1, wherein said blocks are made by dividing the scanning lines of the screen into any one of two groups, four groups and eight groups.

3. A method of driving a plasma display panel in a sub-field system including a reset step initializing each cell of a screen at each sub-field, an addressing step selecting cells to be displayed in each of the reset cells, and a sustaining step causing a sustaining discharge with respect to the addressed cells, the method comprising:

dividing the screen into two or more blocks along scanning lines and applying a reset pulse to only each scanning line of a first block to initialize it and simultaneously allowing the other remaining-immediately reset blocks to have a blanking interval to which pulses are not applied;

sequentially performing an addressing process with respect to the scanning lines in the initialized first block to select the cells to be displayed and, at the same time, performing a sustaining discharging at cells, which are selected in a previous sub-field, included in the other remaining-immediately reset blocks;

allowing the first block in which the addressing process has been completed to have a blanking interval to which pulses are not applied and simultaneously applying a reset pulse to only each scanning line of a second block to initialize it;

performing an addressing process sequentially with respect to the scanning lines in the initialized second block to select the cells to be displayed and, at the same time, performing a sustaining discharging at cells, which are selected in a previous sub-field and a current sub-field, included in the other remaining-immediately reset blocks; and repeating the above steps until the last or the two ore more blocks and then allowing a sustaining discharge for the blocks in the addressing process previously completed to be continued and simultaneously performing a sustaining discharge for the last block after an address process for the last block is completed.

4. The method claimed in claim 3, wherein said two or more blocks are made by dividing the scanning lines of the screen into any one of two groups, four groups and eight groups.

* * * * *